United States Patent [19]

Wilson

[11] Patent Number: 4,626,807

[45] Date of Patent: Dec. 2, 1986

[54] PHASE SHIFTING DEVICE

[75] Inventor: Kenneth Wilson, Middlesex, England

[73] Assignee: The General Electric Company, plc, England

[21] Appl. No.: 744,040

[22] Filed: Jun. 12, 1985

[30] Foreign Application Priority Data

Jun. 25, 1984 [GB] United Kingdom ..... 8416143

[51] Int. Cl.[4] ..... H01P 1/185; H01P 3/08

[52] U.S. Cl. ..... 333/164; 333/156; 333/161

[58] Field of Search ..... 333/1.1, 156, 157, 160, 333/161, 164, 246, 138–140; 332/9, 16, 30 R, 30 V, 23 R

[56] References Cited

U.S. PATENT DOCUMENTS

| | | | |
|---|---|---|---|
| 3,454,906 | 7/1969 | Hyltin et al. | 333/164 |
| 3,506,930 | 4/1970 | Gantick | 333/1.1 X |
| 3,656,069 | 4/1972 | Beccone et al. | 333/156 X |
| 4,205,282 | 5/1980 | Gipprich | 333/164 X |
| 4,275,366 | 6/1981 | Schwarzmann | 333/161 |
| 4,423,393 | 12/1983 | Freitag et al. | 333/161 X |

FOREIGN PATENT DOCUMENTS

| | | |
|---|---|---|
| 1101843 | 1/1968 | United Kingdom . |
| 1179196 | 1/1970 | United Kingdom . |
| 1545883 | 5/1979 | United Kingdom . |

OTHER PUBLICATIONS

Hardin et al—"Electronically-Variable Phase Shifters Utilizing Variable Capacitance Diodes", Proc. IRE, May 1960; pp. 944–945.

Yahara et al—"Broad-Band 180° Phase Shift Section in X Band", IEEE Trans. on Microwave Theory and Techniques, Mar. 1975; pp. 307–309.

*Primary Examiner*—Marvin L. Nussbaum

*Attorney, Agent, or Firm*—Kirschstein, Kirschstein, Ottinger & Israel

[57] ABSTRACT

A phase shifting device including a coupling device having an input port, an output port and a further port. The further port is connected to a transmission line, along the length of which are connected a number of switches. Each switch is operable to connect a low impedance across the transmission line such that an input signal applied to the input port is reflected at a connected one of the switches to produce an output signal at the output port whose phase is shifted relative to that of the input signal by an amount dependent on the length of transmission line traversed by the input signal. Alternatively the capacitance of each of the switches may be operated so as to vary the propagation constant of the transmission line to thereby produce the required phase shift.

8 Claims, 3 Drawing Figures

PHASE SHIFTING DEVICE

This invention relates to phase shifting devices.

More particularly the invention relates to phase shifting devices suitable for fabrication in monolithic microwave integrated circuit form which are capable of providing a range of phase shifts of different values, the particular phase shift imposed on an input signal to the device being dependent on control signals applied to the device.

Known devices of this kind generally are relatively complex or have other problems such as large chip area, or high cost.

It is an object of the present invention to provide a phase shifting device capable of providing a range of phase shifts wherein these difficulties are alleviated.

According to the present invention a phase shifting device comprises: a coupling device having an input port to which an input signal may be applied, an output port from which an output signal may be obtained, and at least one further port connected to a transmission line having a discontinuity; and a plurality of controllable impedances, each controllable impedance being connected at a different location along the length of said transmission line, such that in operation of the device an input signal applied to the input port is reflected at the discontinuity in the transmission line to produce an output signal at the output port whose phase relative to that of the input signal depends on control signals applied to each of the controllable impedances.

One phase shifting device in accordance with the invention will now be described, by way of example only, with reference to the accompanying drawings in which.

Figure 1:
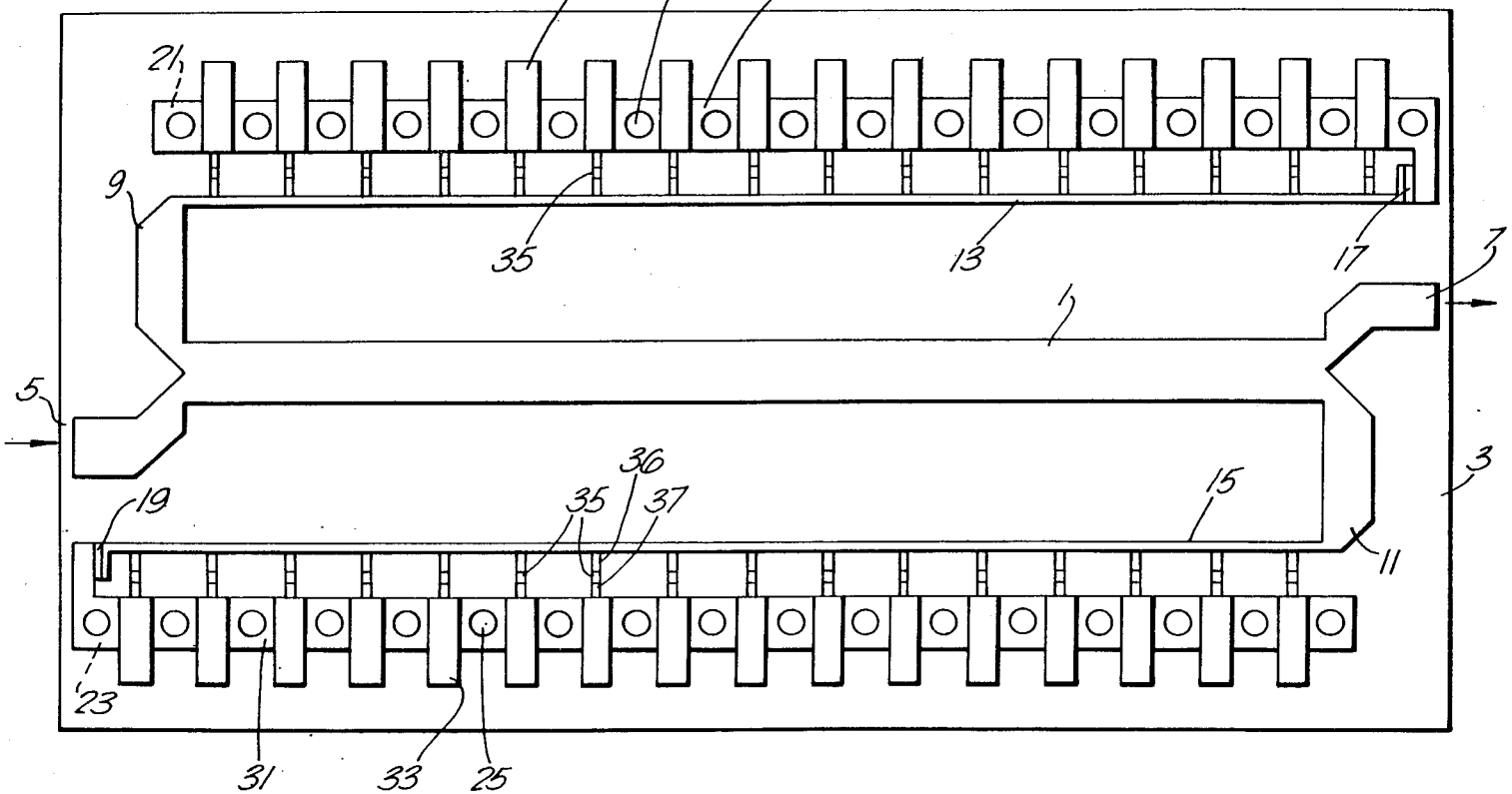
FIG. 1 shows an enlarged plan view of the device.
Figure 2:
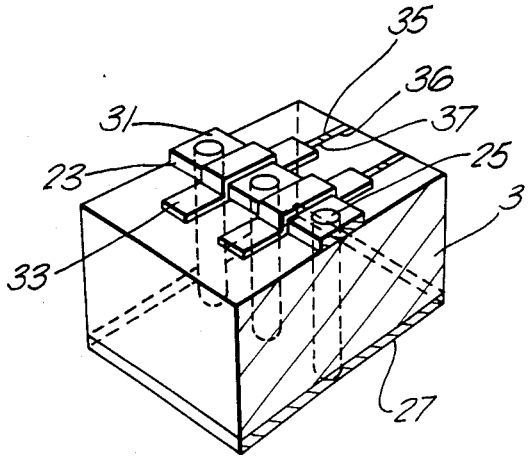
FIG. 2 shows a schematic perspective view of a portion of the device.

Referring firstly to FIGS. 1 and 2, the device is designed for use over a specified frequency range in the microwave frequency band and includes an unfolded Lange coupler comprising a conductive track indicated as 1, formed on one surface of a substrate 3 and a ground plane 4 on the other surface of the substrate. The coupler has an input port 5, an output port 7 and the two further ports 9, 11, each port 9, 11 being connected to one end of a respective conductive track 13 or 15. The ends of the tracks 13, 15 remote from the ports 9, 11 are connected via respective termination resistors 17, 19 to respective earthing bars 21, 23. The bars 21, 23 extend along the surface of the substrate parallel to the lines 13, 15 and are each electrically connected through the substrate via a number of holes indicated as 25 located at intervals along each bar 21, 23 and extending through the substrate 3 to a ground plane 27, as can best be seen in FIG. 2. Over each bar 21, 23 there is deposited a respective dielectric layer 29, 31. At intervals along each bar 21, 23 there are provided metallic strips 33, each strip extending over the dielectric layer 29,31 on the respective bar 21, 23 to form a capacitor. A Schottky diode 35 is connected between each capacitor top plate 33 and the track 13 or 15 by further short lengths of conductive track 36 and 37.

Figure 3:
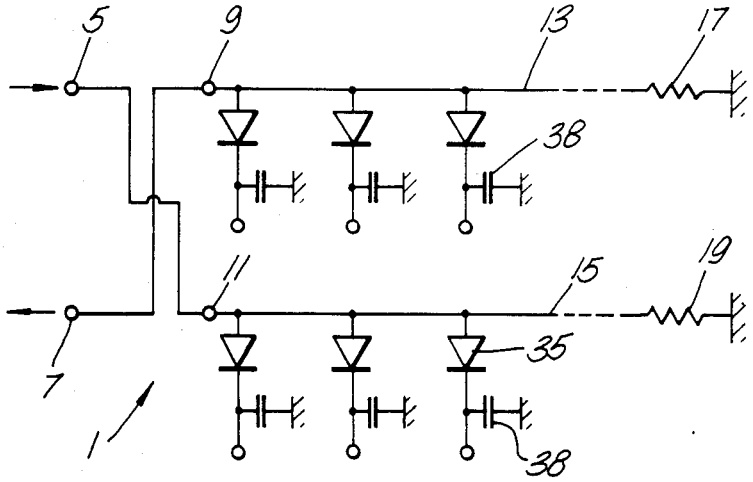
FIG. 3 is an equivalent circuit diagram of the device.

Thus the electrical circuit is as indicated in FIG. 3, a respective capacitor 38 constituted by a respective one of strips 33, dielectric layer 29 or 31 and a bar 21 or 23 being provided between each diode 25 and earth, the tracks 13 and 36 or 15 and 37 constituting the inductive portions of respective tranmission lines, with the diodes 35 constituting the capacitive portions of the respective lines.

In use of the device, an input signal of appropriate frequency is applied to the port 5, a portion of this signal then passing through port 9 and a further portion passing through port 11. A d.c. bias is applied to a diode 35, of corresponding position on each of the tracks 13, 15 via the corresponding metallic strips 33 so as to cause these diodes to become conductive to the signals passing onto the lines 13, 15 via the ports 9, 11 the choice of diode being dependent on the required phase shift as further described hereafter. The connection from the track 13 and 15 through the conductive diodes, the track 36, 37 and the capacitor formed by the strip 33, layer 29 or 31 and bar 21 or 23 to ground is an effective short circuit for signals of these frequencies compared with the characteristic impedance of the transmission lines so causing the signals to be reflected back along the lines to pass back into the coupler via the ports 9, 11 respectively. An output signal will then be produced at the port 7 in which the phase shift imposed on the input signal by its transversal and subsequent reflection through either of the lines 13, 15 is in the same sense, the signals reflected back to the port 5 cancelling out due to the form of the coupler. The magnitude of the phase shift of this output signal, with respect of the phase of the input signal, is dependent on the length of transmission line through which the signals have passed, which is in turn determined by the choice of diodes which are caused to be conductive.

In one particular device as described the characteristic impedance of the transmission lines and the positions at which the diodes 35 are connected to the lines are chosen so that the effective characteristic impedance of whole structure becomes 50 ohms and the propagation delay between each tapping point on the lines corresponds to $11\frac{1}{4}°$ at a specified signal frequency. As the signal propagates through each section twice (i.e. both before and after reflection) it will be appreciated that the phase delay through the complete circuit can be controlled in increments of $22\frac{1}{2}°$; for 16 sections therefore, control is available over a full 360° by selecting which diodes are biassed into a conductive state.

It will be appreciated that the device described herebefore may also be used as a continously variable phase shifter. This may be achieved by permanently biassing the diodes 35 nearest the termination resistors 17, 19 to a conductive state, and reverse biassing all the other diodes 35 by the same voltage. By varying this reverse biassing voltage the diode junction capacitance is varied and hence so is the effective propagation constant of the transmission lines. In this way a continuous or analogue control of phase can be achieved. Two identical devices, one with digital phase control and one with analogue phase control could conveniently be cascaded to enable the overall phase shift to be set to any desired value, the digital device giving the approximate value, and the analogue device giving the exact device.

In an alternative device in accordance with the invention, the terminating resistors 17, 19 may be replaced by either short circuits or open circuits, with all the diodes 35 being reverse biassed.

It will also be appreciated that whilst in the device described herebefore by way of example Schottky diodes are used as the controllable impedances to select the value of phase shift, any otr form of controllable impedance may also be used in a phase shifting device in accordance with the invention, although the reactance of the variable impedance must be taken into account when designating the dev1ce. One example of an alternate controllable impedance is an appropriately biassed field effect transistor.

It will also be appreciated that whilst a Lange coupler is a particularly convenient coupling device in some applications, e.g. for use in a monolithic microwave integrated circuit, other coupling devices such as circulators may alternatively be utilised in a device in accordance with the invention. Such alternative coupling devices may have one, or more than two further ports in addition to an input port and an output port.

It will also be appreciated that whilst the invention has particular application to devices in which the transmission line and coupling device are in the form of a conductive track carried on one surface of a substrate, with a ground plane carried on the reverse surface of the substrate, the invention may also be put into effect with other forms of transmission line and coupling device, e.g. stripline or coplanar waveguide.

It will also be appreciated that the conductive tracks 13, 15 may be replaced by a series arrangement of individual inductors.

I claim:

1. A phase shifting device comprising: a coupling device having an input port to which an input signal is applied, an output port from which an output signal is derived and at least one further port to which is connected a transmission line terminated in a discontinuity effective to reflect signals from the input port passing along the line back along the line to produce said output signal, said transmission line being constituted by a series of inductances formed by successive portions of a conductive track carried on one main face of a substrate whose other main face carries a ground plane, and a plurality of capacitive impedances each connected between the end of a respective portion of said track and the ground plane, the values of said impedances being controllable by control signals so as to vary the phase of said output signal respective to the phase of said input signal.

2. A device according to claim 1 in which the control signals are arranged to control the capacitance of the capacitive impedances and thus the propagation constant of the transmission line, between the further port and the discontinuity.

3. A device according to claim 1 in which the coupling device is a Lange coupler having two of said further ports, each connected to a respective transmission line.

4. A device according to claim 1 for use at microwave frequencies in which each capacitive impedance is connected across said transmission line via a capacitance and which serves as a blocking capacitor for control signals applied to the capacitive impedance.

5. A device according to claim 4 in which each capacitive impedance is connected between a respective location along the transmission line conductive track and a respective conductive strip forming one electrode of the associated capacitance, each strip overlying a dielectric layer which in turn overlies a respective portion of a conductive bar, which portions form the other electrodes of the capacitances, the strips, dielectric layer and conductive bar all being carried on the one main faces of the substrate.

6. A device according to claim 5 in which the conductive bar is electrically connected to the earth plane adjacent each said respective location by a respective electrically conductive member which passes through the substrate.

7. A device according to claim 1 in which each of the capacitive impedances comprises a diode.

8. A device according to claim 1 wherein said control signals are arranged to cause a selected capacitive impedance to become a short circuit and so provide said discontinuity at the location of that selected capacitive impedance.

* * * * *